US011013287B2

(12) United States Patent
Daburn

(10) Patent No.: US 11,013,287 B2
(45) Date of Patent: May 25, 2021

(54) GOGGLE RETENTION APPARATUS

(71) Applicant: Ian John Daburn, Vancouver (CA)

(72) Inventor: Ian John Daburn, Vancouver (CA)

( * ) Notice: Subject to any disclaimer, the term of this patent is extended or adjusted under 35 U.S.C. 154(b) by 110 days.

(21) Appl. No.: 16/420,770

(22) Filed: May 23, 2019

(65) Prior Publication Data

US 2020/0367594 A1 Nov. 26, 2020

(51) Int. Cl.
*A42B 3/18* (2006.01)

(52) U.S. Cl.
CPC ..... *A42B 3/185* (2013.01)

(58) Field of Classification Search
CPC ..... A42B 3/185; A42B 3/222; A42B 3/04; A42B 3/0406; A42B 1/247; A42B 3/147; A42B 3/30; A42B 1/0184
See application file for complete search history.

(56) References Cited

U.S. PATENT DOCUMENTS 2,538,608 A * 1/1951 Vaca ..... A61F 9/025 2/10
4,193,133 A * 3/1980 Laibach ..... A42B 3/185 2/10
4,276,657 A * 7/1981 Montesi ..... A42B 3/185 2/10
4,686,712 A * 8/1987 Spiva ..... A42B 3/185 2/10
4,764,989 A * 8/1988 Bourgeois ..... A42B 3/185 2/10
5,937,439 A * 8/1999 Barthold ..... A42B 3/04 2/10
D617,055 S * 6/2010 Higgins ..... D29/122
9,398,781 B1 * 7/2016 McCorkle ..... A42B 3/185
9,452,085 B2 * 9/2016 Gisquiere ..... A61F 9/027
2003/0093853 A1 * 5/2003 Maloney ..... A42B 3/185 2/425
2008/0172775 A1 * 7/2008 Higgins ..... A42B 3/185 2/422

(Continued)

*Primary Examiner* — Amy Vanatta
(74) *Attorney, Agent, or Firm* — Capehart Law Firm

(57) ABSTRACT

A goggle retaining apparatus to secure a pair of goggles having a goggle strap to a helmet. The apparatus having a first and second retaining component affixed to the sides of the helmet at a position substantially in line with the goggle strap when the pair of goggles is placed over the eyes of a wearer. The retaining components have a base member being secured to the side of the helmet and a retaining member secured to the base member. The retaining member is configured to receive the goggle strap when the pair of goggles is placed over the eyes of the wearer. The retaining component is configured to engage the goggle strap when the pair of goggles is moved upward from the eyes of the wearer such that the rear portion of the goggle strap located to the rear of the retaining component remains at a position substantially in line with the position of the goggle strap when the pair of goggles is placed over the eyes of a wearer. A stopping member is affixed to the crown of the helmet at approximately an equal distance between the retaining components and proximate to the front of the helmet. The stopping member has an elongated body extending away from the helmet such that the pair of goggles is engaged against the elongated body when the pair of goggles is moved upward from the eyes of the wearer.

7 Claims, 14 Drawing Sheets

(56) References Cited

U.S. PATENT DOCUMENTS

| | | | | |
|---|---|---|---|---|
| 2010/0325784 | A1* | 12/2010 | Abbott | A42B 3/185 2/422 |
| 2011/0099694 | A1* | 5/2011 | Guida | A42B 3/185 2/422 |
| 2012/0047765 | A1* | 3/2012 | Kolesar | F26B 9/003 34/442 |
| 2012/0180202 | A1* | 7/2012 | McNeal | A42B 3/185 2/422 |
| 2014/0068845 | A1* | 3/2014 | Corey, Jr. | A42B 3/185 2/422 |

* cited by examiner

FIG. 1 – Prior Art

FIG. 2 – Prior Art

GOGGLE RETENTION APPARATUS

REFERENCE TO PENDING APPLICATIONS

This application does not claims the benefit of pending application.

BACKGROUND OF THE INVENTION

1. Field of the Invention

The present invention is generally directed toward a goggle retention device, more specifically toward a goggle retention apparatus and method that can prevent the goggles from sliding off a helmet.

2. Description of the Related Art

The use of helmets to prevent head injury is common place with many activities, including snow skiing, snowboarding, motorcycle riding and bicycle riding. Further, as illustrated in FIG. 1, protective goggles 17 are typically worn to provide protection from eye injury and the air. The goggles 17 are normally held in place by an elastic goggle strap 18 that wraps around the outside of the helmet 10.

Occasionally, as illustrated in FIG. 2, the goggles 17 will be removed from the face and placed on top, or on the crown 16, of the helmet 10. However, due to the elastic nature of the strap 18, the goggles 17 may be pulled along the surface of the helmet 10 causing the goggles 17 to slip off the helmet 10 and become lost.

Prior art efforts to address this issue have included utilized an anchor strap, sometimes referred to as goggle mount, that is secured to the back 13 of the helmet 10. This effort while preventing the loss of the goggles 17, however, created another disadvantage. When the goggles 17 slip off, the anchor strap allows goggles 17 to become disengaged from, and dangle behind, the helmet 10.

Accordingly, there is a need for a goggle retention apparatus that addresses the needs set out above.

SUMMARY OF THE INVENTION

In one aspect of the present invention, a goggle retaining apparatus to secure a pair of goggles having a goggle strap to a helmet is disclosed. The apparatus includes first and second retaining components, each of which are affixed to opposing sides of a helmet at a position substantially in line with the goggle strap when the pair of goggles is placed over the eyes of a wearer.

Each of the retaining components have a base member being secured to the side of the helmet and a retaining member secured to the base member. The retaining member is configured to receive the goggle strap when the pair of goggles is placed over the eyes of the wearer.

The retaining components are configured to engage the goggle strap when the pair of goggles is moved upward from the eyes of the wearer such that the rear portion of the goggle strap located to the rear of the retaining component remains at a position substantially in line with the position of the goggle strap when the pair of goggles is placed over the eyes of a wearer. As used herein, the terms forward and rear are used in relation to the front and rear portions of the helmet. For example, the term the rear portion of the goggle strap located to the rear of the retaining component means that portion of the goggle strap that is located between the rear, or back, of the helmet and the retaining component. Further, when terms are such as behind or in front of are used, the location is in relation to the relative position on the helmet. For example, the term located behind the retaining component refers to a position being further toward the back of the helmet than the retaining component. Further, the term crown means the portion of the helmet that protects the portion of the head above the eyeline of the user.

In some aspects, the base members have a pivot channel configured to receive the associated first or second retaining member and a pivot pin configured to pivotally secure the associated first or second retaining member within the pivot channel. The ability to pivot may relieve some bunching of the goggle strap and reduce the stress on the retaining members caused by the pulling forces exerted of the elastic goggle strap on the retaining members.

In some aspects, the retaining members may have a front retaining arm and a rear retaining arm. The rear retaining arm is located substantially in-line with and toward the rear of the front retaining arm. A retaining slot is defined between the front and rear retaining arms and configured to receive the goggle strap.

This some aspects, the goggle retaining apparatus further includes a stopping member that is affixed to the crown, or top, of the helmet at approximately an equal distance between the first and second retaining component and proximate to the front of the helmet. In this aspect, the stopping member has an elongated body extending away from the helmet such that the pair of goggles is engaged against the elongated body when the pair of goggles is moved upward from the eyes of the wearer.

In some aspects, the elongated body may include a front facing side facing the front of the helmet and rear facing side facing the rear of the helmet, The front facing side has a curvature that is configured to receive the pair of goggles when is moved upward from the eyes of the wearer.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, portable mattress seat, constructed and operative according to the teachings of the present invention.

The various embodiments of the present invention will hereinafter be described in conjunction with the appended drawings, wherein like designations denote like elements.

DETAILED DESCRIPTION

The present invention is generally directed toward a goggle retaining apparatus that is configured to secure a pair of goggles having a goggle strap to a helmet. The apparatus includes first and second retaining components, each of which are pivotally affixed to opposing sides of a helmet at a position substantially in line with the goggle strap when the pair of goggles is placed over the eyes of a wearer. A stopper component is located along the front portion of the crown of the helmet and is configured to engage the pair of goggles is moved upward from the eyes of the wearer. The retaining components are configured to retain the goggle strap therein thereby shortening that portion of the goggle strap that is moved upward and thus securing the pair of goggles to the helmet.

Figure 1:
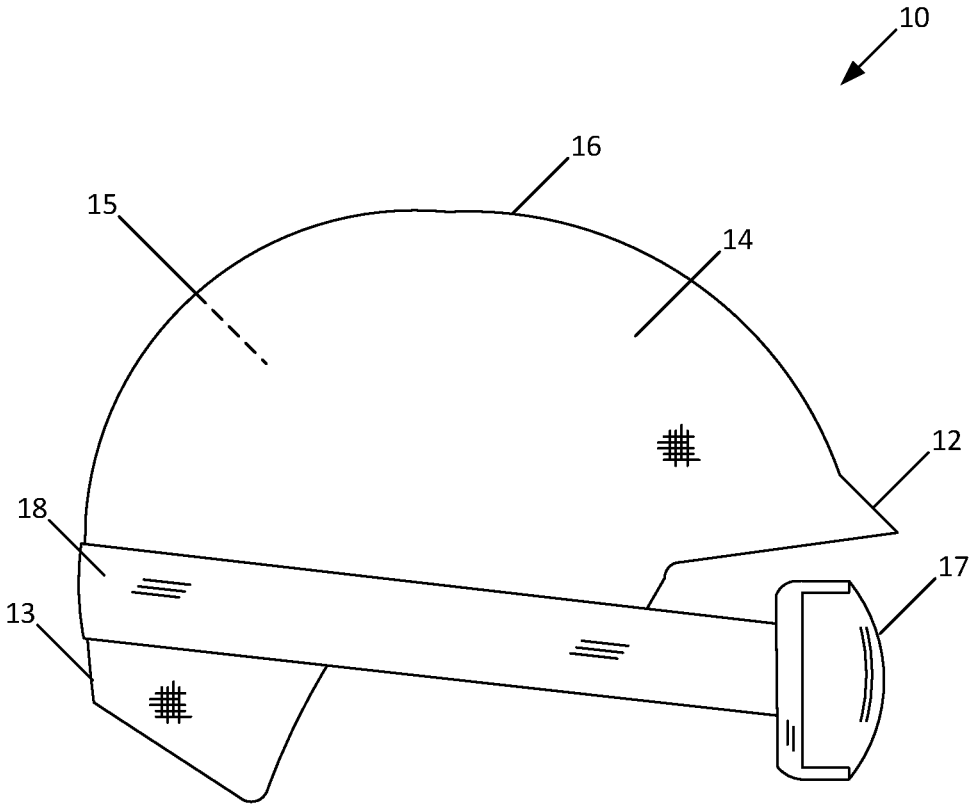
FIG. 1 is a side perspective view of a prior art helmet and pair of goggles when the pair of goggles are placed over the eyes of a wearer.
Figure 2:
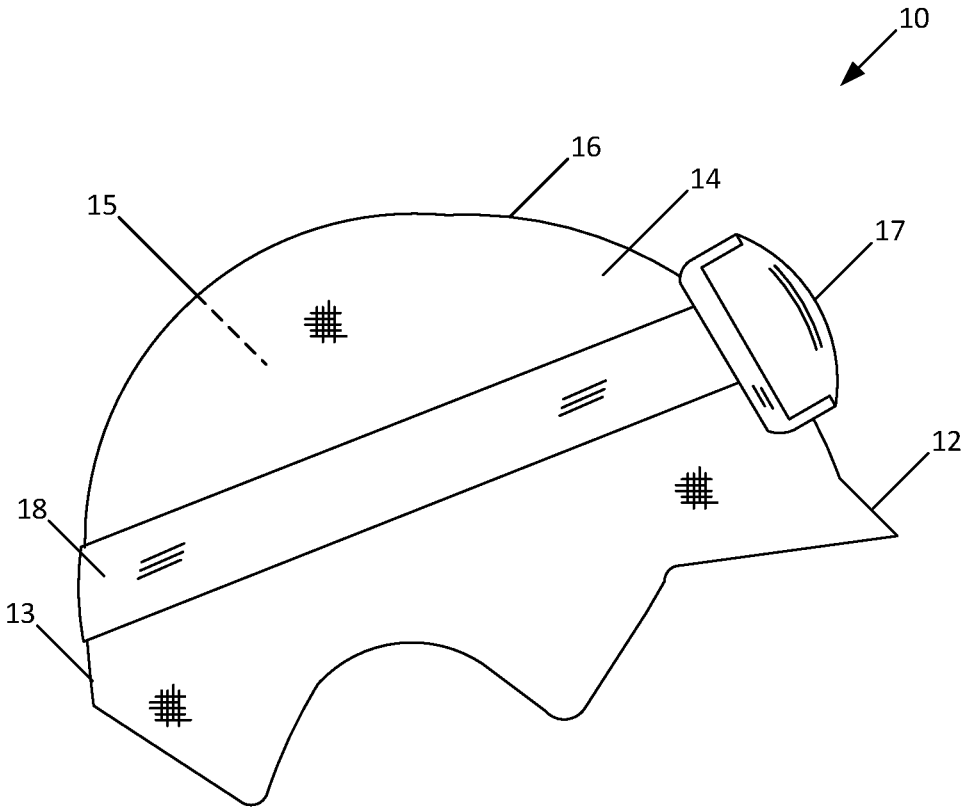
FIG. 2 is a side perspective view of a prior art helmet and pair of goggles when the pair of goggles are placed on the crown of the helmet.
Figure 3:
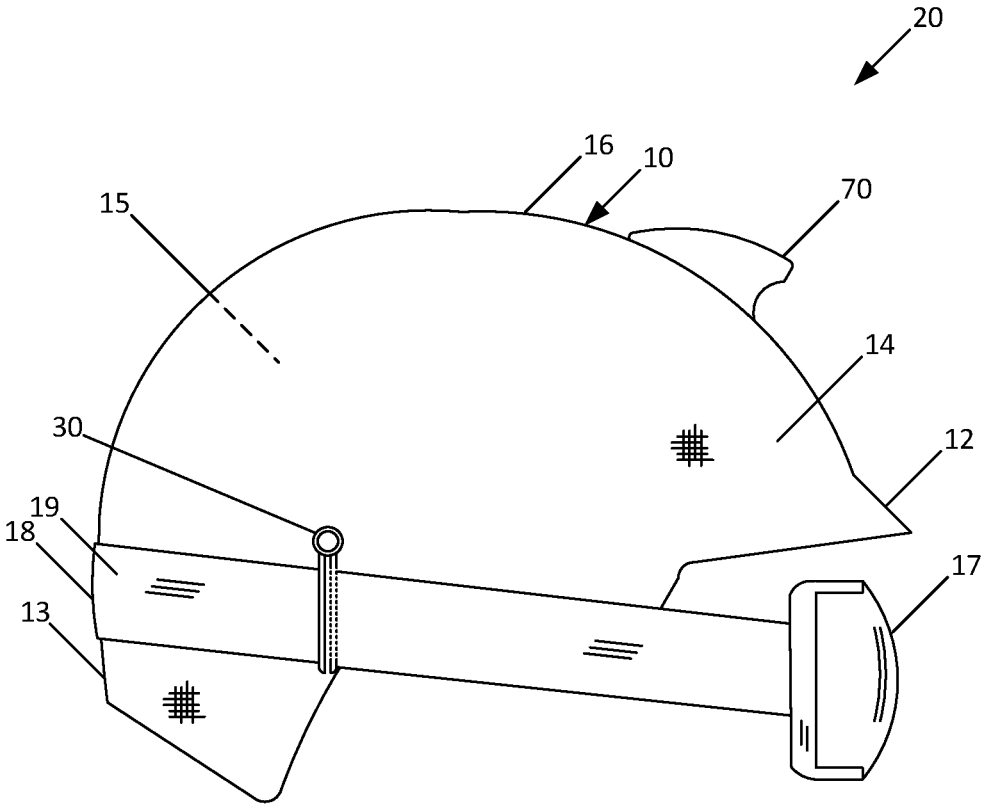
FIG. 3 is a side perspective view of an embodiment of the present invention from a first side in use with a helmet and pair of goggles when the pair of goggles are placed over the eyes of a wearer.
Figure 4:
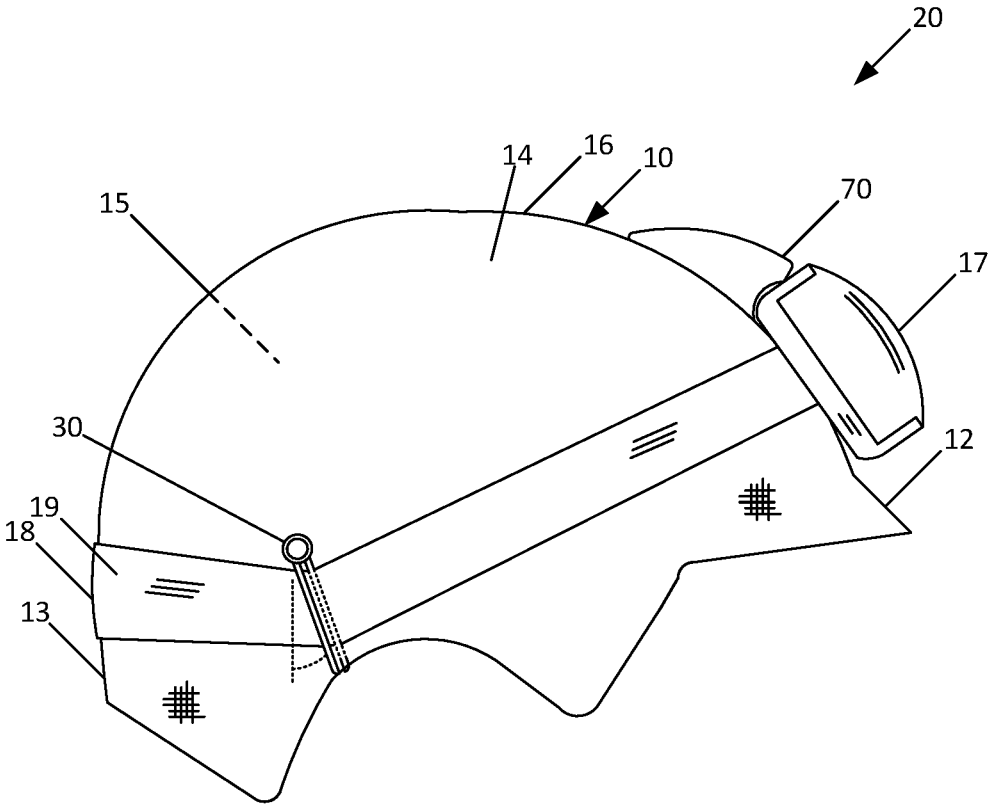
FIG. 4 is a side perspective view of an embodiment of the present invention from a first side in use with a helmet and pair of goggles when the pair of goggles are placed on the crown of the helmet.
Figure 5:
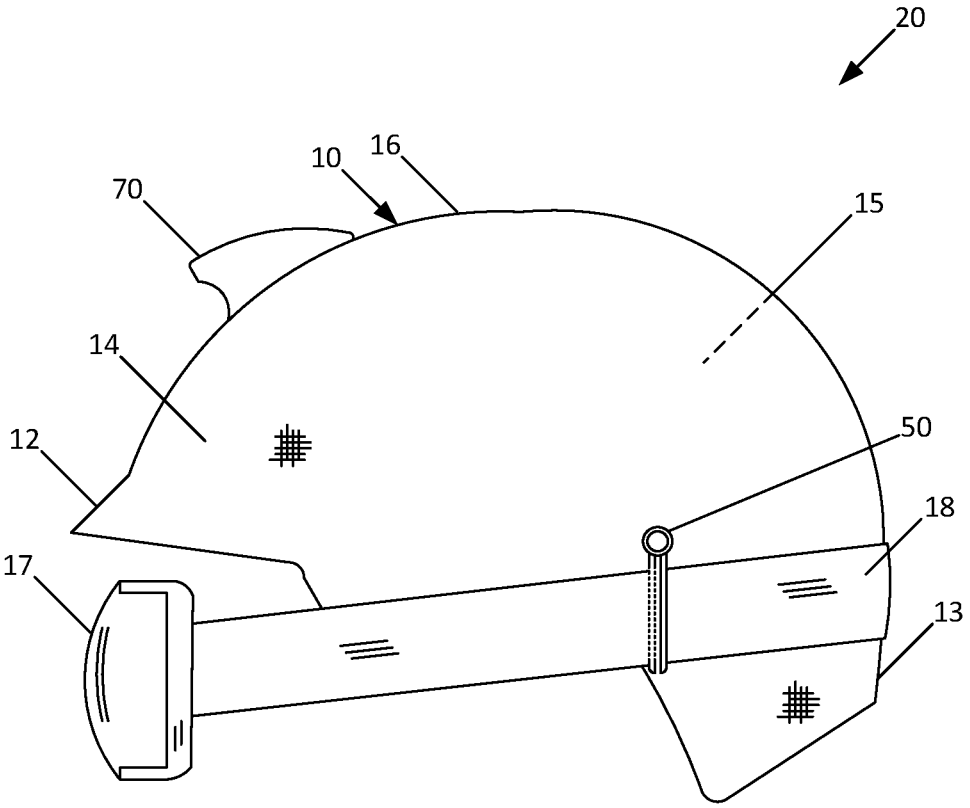
FIG. 5 is a side perspective view of an embodiment of the present invention from a second side in use with a helmet and pair of goggles when the pair of goggles are placed over the eyes of a wearer.

As illustrated in FIGS. 3-5, an embodiment of a goggle retaining apparatus 20 of the present invention is disclosed. Apparatus 20 is configured to secure a pair of goggles 17 having a goggle strap 18 to a helmet 10 in order to prevent accidental, or inadvertent, removal of the pair or goggles 17 from around the helmet 10.

In this embodiment, apparatus 20 includes a first retaining component 30 affixed to a first side 14 of a helmet 10 and a second retaining component 50 affixed to a second side 15 of the helmet 10. Both the first and second retaining components 30, 50 are located at a position on the sides 14, 15 of helmet 10 that is substantially in line with the goggle strap 18 when the pair of goggles 17 is placed over the eyes of a wearer. In this embodiment, this location is behind the ear of the wearer.

In this embodiment, as illustrated in FIGS. 6-9, the first retaining component 30 includes a first base member 32 being secured to the first side 14 of the helmet 10 and a first retaining member 34 secured to the first base member 32. The first retaining member 34 is configured to receive the goggle strap 18 when the pair of goggles 17 is placed over the eyes of the wearer. This allows the first retaining component 30 to engage the goggle strap 18 when the pair of goggles 17 is moved upward from the eyes of the wearer. This allows the rear portion 19 of the goggle strap 18 that is located to the rear of the first retaining component 34 to remain at a position substantially in line with the position of the goggle strap 18 when the pair of goggles 17 is placed over the eyes of a wearer.

Figure 6:
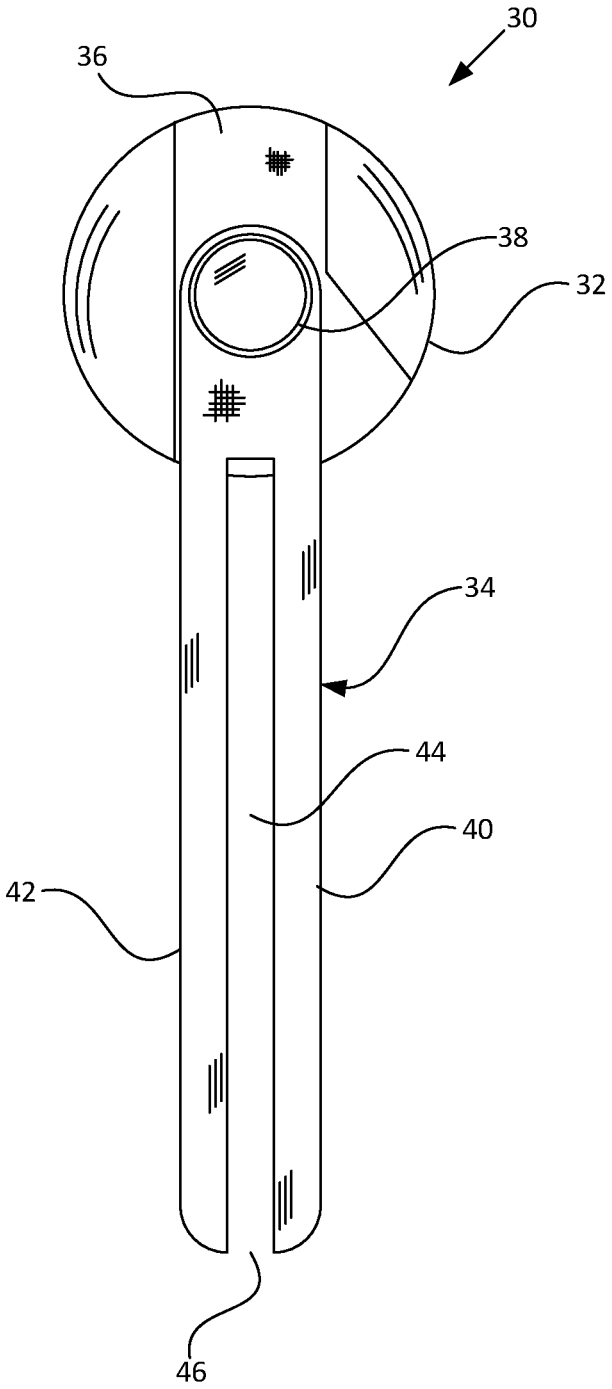
FIG. 6 is a front view of an embodiment of a retaining component of the present invention.
Figure 7:
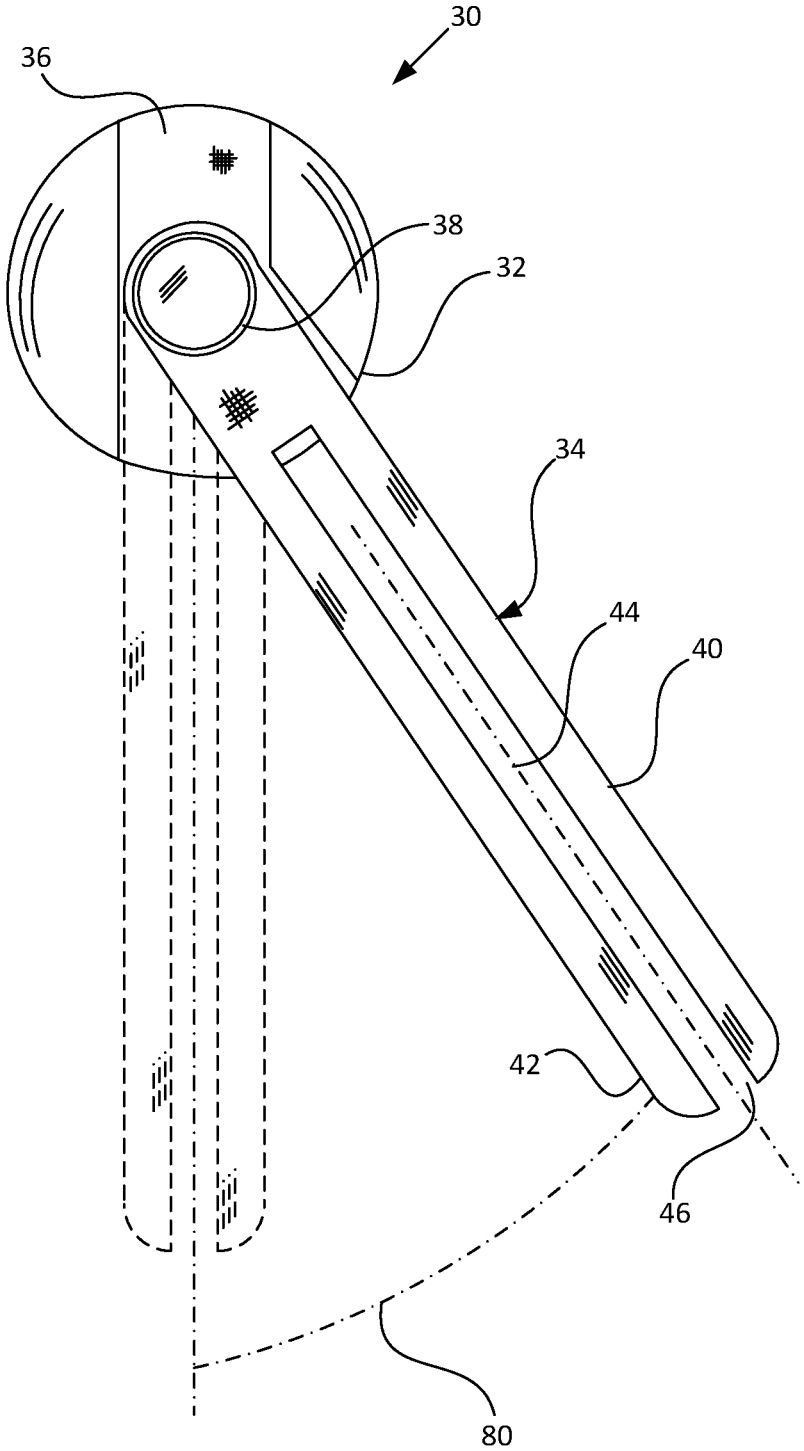
FIG. 7 is a front view of an embodiment of a retaining component of the present invention illustrating an embodiment of a retaining member in a rotated position about an embodiment of a pivot pin of the present invention.
Figure 8:
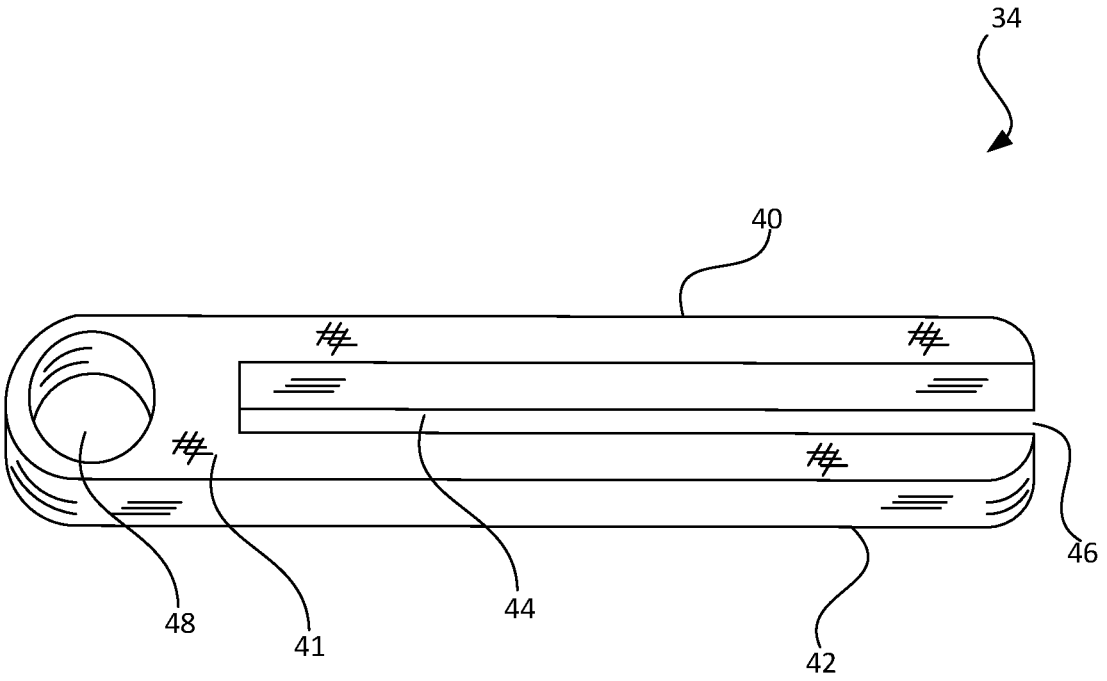
FIG. 8 is a perspective view of an embodiment of a retaining member of the present invention.
Figure 9:
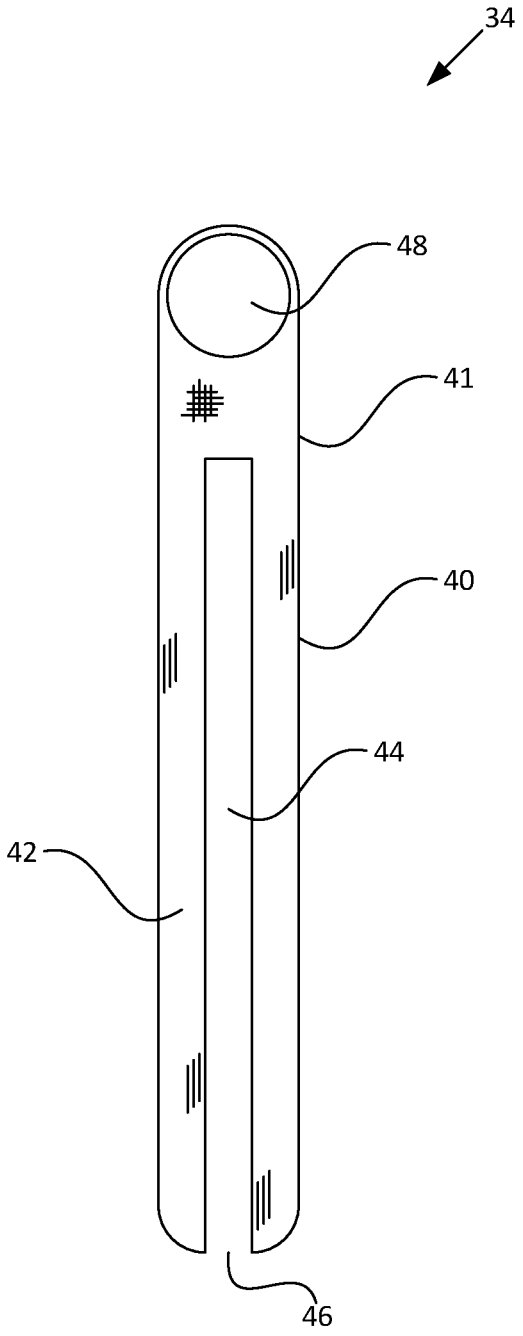
FIG. 9 is a top view of an embodiment of a retaining member of the present invention.
Figure 11:
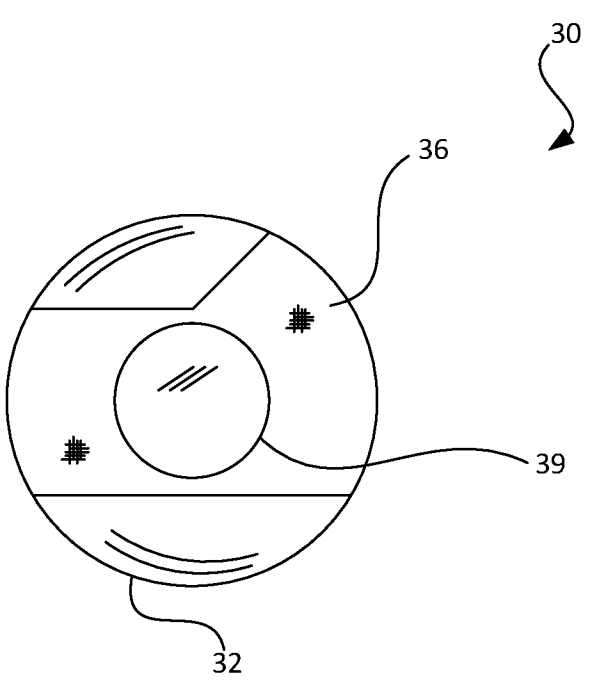
FIG. 11 is a top view of an embodiment of a base member of the present invention.
Figure 10:
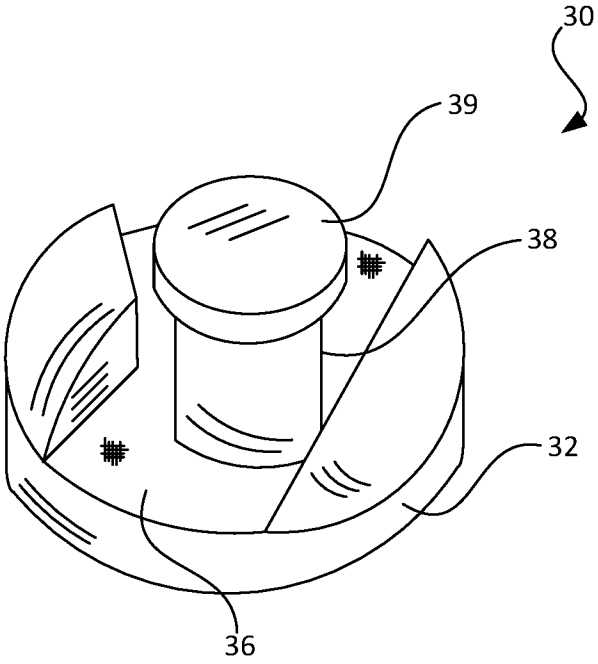
FIG. 10 is a perspective view of an embodiment of a base member of the present invention.
Figure 13:
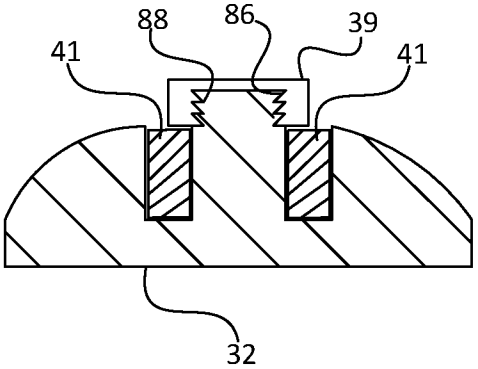
FIG. 13 is a cross-sectional view of the embodiment of a base member of the present invention of FIG. 12 in use.
Figure 12:
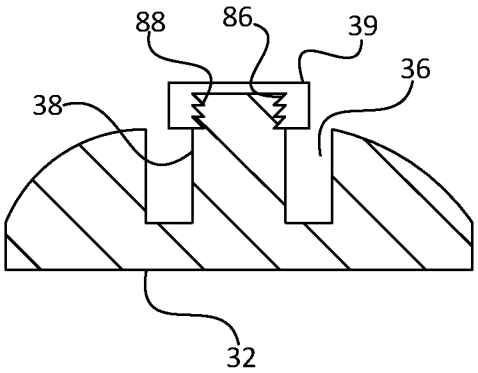
FIG. 12 is a cross-sectional view of an embodiment of a base member of the present invention.

In this embodiment, as illustrated in FIGS. 10-13, the first base member 32 includes a pivot channel 36 having a pivot pin 38 having a male threaded screw fastener 86 that is configured threadedly mate with pin cap 39 having a female threaded screw fastener 88. Pivot channel is configured to receive the first retaining member 34. Pivot pin 38 secures first retaining member 34 within pivot channel 36. Pivot channel 36 is configured to allow the first retaining member 34 to have a limited pivoting movement within the channel, as illustrated in FIGS. 5-6. The pivoting movement of the first retaining member 34 allows for goggle strap 18 to have a slight movement when the pair of goggles are move to the crown 16 of the helmet 10. This slight movement reduces the stress on the first retaining member 34 caused by the pulling forces exerted of the elastic goggle strap on the retaining members and may relieve some bunching of the goggle strap.

Figure 15:
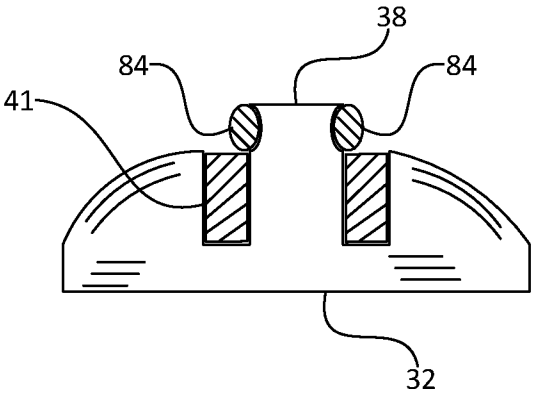
FIG. 15 is a cross-sectional view of the embodiment of a base member of the present invention of FIG. 14 in use.
Figure 14:
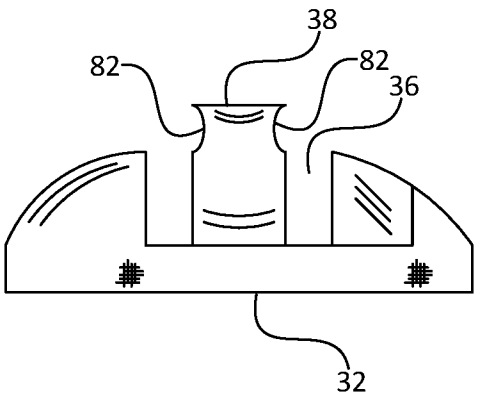
FIG. 14 is a cross-sectional view of an additional embodiment of a base member of the present invention.

In an additional embodiment of first base member 32, as illustrated in FIGS. 14-15, pivot pin 38 has a curvature 82 configured to receive a flexible retention ring 84. In use, the first retaining member 34 passes over retention ring 84 is positioned within pivot channel 36. Retention ring 84 secures the first retaining member 34 within pivot channel 36.

In some embodiments, referring back to FIGS. 6-9, an embodiment of the first retaining member 34 is disclosed. First retaining member 34 is secured to the first base member 32 and includes a front retaining arm 40 and a rear retaining arm 42 located substantially in-line with and toward the rear of the front retaining arm 40. The front and rear retaining arms 40, 42 extend in a downward direction from the first base member 32 and define a retaining slot 44 therebetween. The retaining slot 44 has an open lower end 44 to allow for the placement of a goggle strap 17. In this embodiment, first retaining member 34 is disclosed as having two retaining arms. This is illustrative and not meant to be limiting. Those skilled in the art will recognize that it is within the scope of the present invention the retaining member may have a plurality of retaining arms.

FIGS. 6-15 illustrated an embodiment of the first retaining component 30. However, second retaining component 50 is designed and configured in the same manner as the first retaining component 30 and would be a considered a mirror image thereof.

Figure 16:
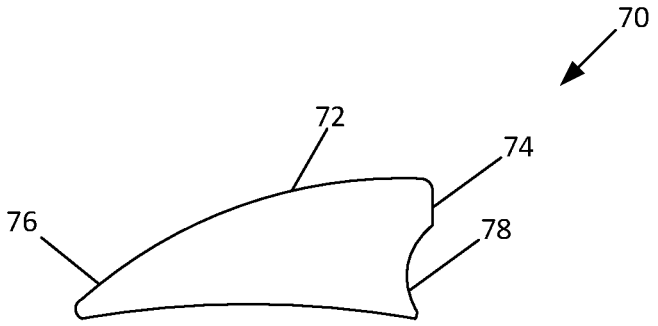
FIG. 16 is a front view of an embodiment of a stopping member of the present invention.
Figure 17:
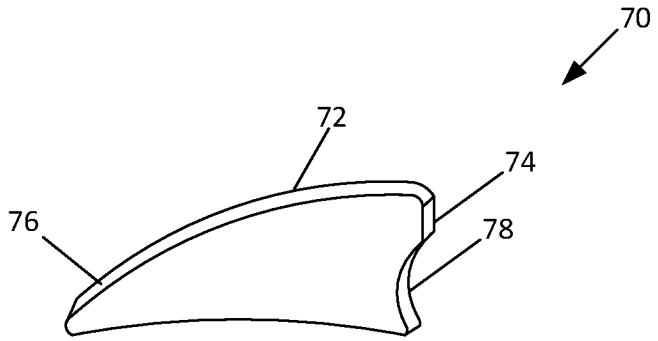
FIG. 17 is a perspective view of an embodiment of a stopping member of the present invention.
Figure 18:
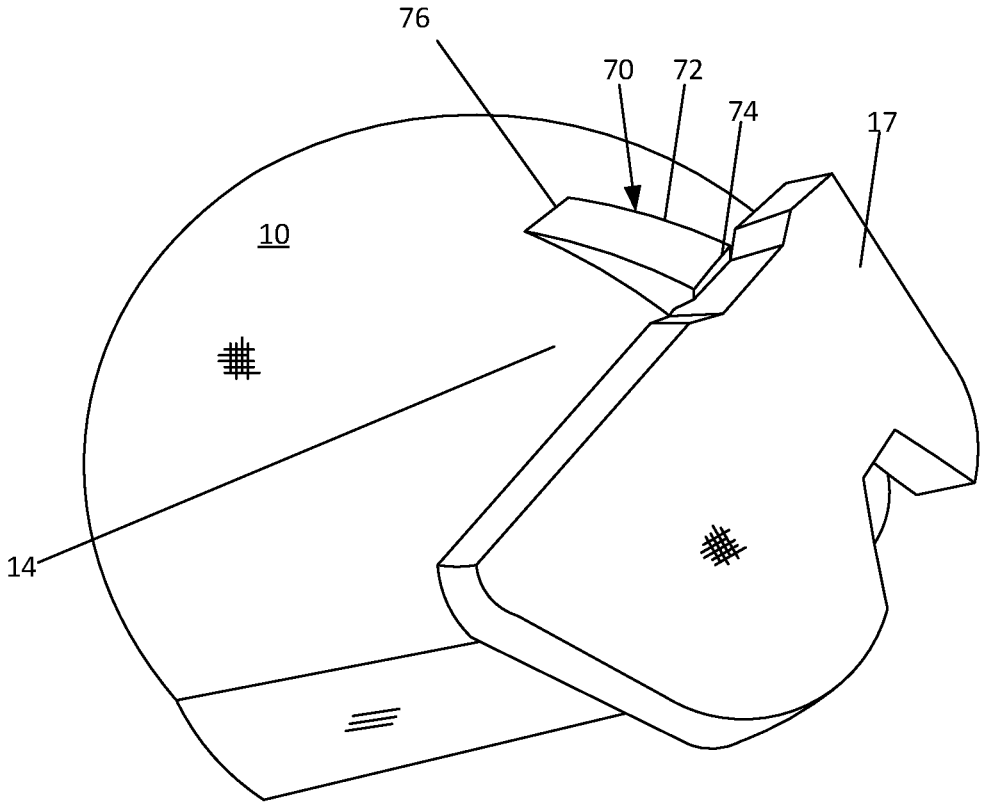
FIG. 18 is a front perspective view of an embodiment of the present invention from a first side in use with a helmet and pair of goggles illustrating the pair of goggles resting against an embodiment of a stopping member of the present invention.

As illustrated in FIGS. 16-18, an embodiment of the stopping member 70 is disclosed. Stopping member 70 is affixed to the crown 16 of the helmet 10 at approximately an equal distance between the first and second retaining components 30, 50 and proximate to the front 12 of the helmet 10. The stopping member 70 has an elongated body 72 that extends away from the helmet 10. The elongated body 72 has a front facing side 74 that has a curvature 78 that faces the front 12 of the helmet 10 and a rear facing side 76 facing the rear 13 of the helmet 10. Stopping member is configured to allows the pair of goggles 17 to engaged, or rest against, the front facing side 76 of the elongated body 72 when the pair of goggles 17 is moved upward from the eyes of the wearer. The curvature 78 assists the engagement of the pair of goggles 17.

The exact specifications, materials used, and method of use of the goggle retention apparatus may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

I claim:

1. A goggle retaining apparatus to secure a pair of goggles having a goggle strap to a helmet having a front, rear and crown, the apparatus comprising:

a first retaining component affixed to a first side of a helmet at a position substantially in line with the goggle strap when the pair of goggles is placed over the eyes of a wearer, the first retaining component having a first base member being secured to the first side of the helmet, a first retaining member secured to the first base member and extending away from the first base member in a substantially vertical orientation, the first retaining member configured to receive the goggle strap when the pair of goggles is placed over the eyes of the wearer, the first retaining member having a first front retaining arm extending away from the first base member in a substantially vertical orientation; and a first rear retaining arm extending away from the first base member in a substantially vertical orientation, the first rear retaining arm located substantially in-line with and toward the rear of the first front retaining arm, the first front retaining arm and the first rear retaining arm defining a first retaining slot having a first open lower end, the first open lower end being distal to the first base member, the first retaining slot configured to receive the goggle strap through the open lower end such that either the first front retaining arm or the first rear retaining arm is positioned between the goggle strap and the helmet and goggle strap is positioned between the other of the first front retaining arm or the first rear retaining arm and the helmet and a second retaining component affixed to a second side of the helmet at a position substantially in line with the goggle strap when the pair of goggles is placed over the eyes of a wearer, the second side of the helmet being an opposing side of the helmet from the first side of the helmet, the second retaining component having a second base member being secured to the second side of the helmet, a second retaining member secured to the second base member and extending away from the second base member in a substantially vertical orientation, the second retaining member configured to receive the goggle strap when the pair of goggles is placed over the eyes of the wearer, the second retaining member having a second front retaining arm extending away from the second base member in a substantially vertical orientation; and a second rear retaining arm extending away from the second base member in a substantially vertical orientation, the second rear retaining arm located substantially in-line with and toward the rear of the second front retaining arm, the second front retaining arm and the second rear retaining arm defining a second retaining slot having a second open lower end, the second open lower end being distal to the second base member, the second retaining slot configured to receive the goggle strap through the open lower end such that either the second front retaining arm or the second rear retaining arm is positioned between the goggle strap and the helmet and goggle strap is positioned between the other of the second front retaining arm or the second rear retaining arm and the helmet.

2. The goggle retention apparatus of claim 1, further comprising:

a stopping member affixed to the crown of the helmet at approximately an equal distance between the first and second retaining component and proximate to the front of the helmet, the stopping member having an elongated body extending away from the helmet such that the pair of goggles is engaged against the elongated body when the pair of goggles is moved upward from the eyes of the wearer.

3. The goggle retention apparatus of claim 2, wherein the elongated body of the stopping member is further defined as having a front facing side facing oriented toward the front of the helmet and a rear facing side oriented toward the rear of the helmet, the front facing side having a curvature configured to receive the pair of goggles when the pair of goggles are placed on the crown of the helmet.

4. The goggle retention apparatus of claim 1, wherein each of the first and second base members comprising:

a pivot channel configured to receive the associated first or second retaining member; and a pivot pin configured to pivotally secure the associated first or second retaining member within the pivot channel, such that the associated first or second retaining member can pivot around the pivot pin between a substantially vertical orientation and a non-vertical orientation.

5. A goggle retaining apparatus to secure a pair of goggles having a goggle strap to a helmet having a front, rear and crown, the apparatus comprising:

a first retaining component affixed to a first side of a helmet at a position substantially in line with the goggle strap when the pair of goggles is placed over the eyes of a wearer, the first retaining component having a first base member being secured to the first side of the helmet, a first retaining member secured to the first base member and extending away from the first base member in a substantially vertical orientation, the first retaining member configured to receive the goggle strap when the pair of goggles is placed over the eyes of the wearer, the first retaining member having a first front retaining arm extending away from the first base member in a substantially vertical orientation; and a first rear retaining arm extending away from the first base member in a substantially vertical orientation, the first rear retaining arm located substantially in-line with and toward the rear of the first front retaining arm, the first front retaining arm and the first rear retaining arm defining a first retaining slot having a first open lower end, the first open lower end being distal to the first base member, the first retaining slot configured to receive the goggle strap through the open lower end such that either the first front retaining arm or the first rear retaining arm is positioned between the goggle strap and the helmet and goggle strap is positioned between the other of the first front retaining arm or the first rear retaining arm and the helmet; and a second retaining component affixed to a second side of the helmet at a position substantially in line with the goggle strap when the pair of goggles is placed over the eyes of a wearer, the second side of the helmet being an opposing side of the helmet from the first side of the helmet, the second retaining component having a second base member being secured to the second side of the helmet, a second retaining member secured to the second base member and extending away from the second base member in a substantially vertical orientation, the second retaining member configured to receive the goggle strap when the pair of goggles is placed over the eyes of the wearer, the second retaining member having a second front retaining arm extending away from the second base member in a substantially vertical orientation; and a second rear retaining arm extending away from the second base member in a substantially vertical orientation, the second rear retaining arm located substantially in-line with and toward the rear of the second front retaining arm, the second front retaining arm and the second rear retaining arm defining a second retaining slot having a second open lower end, the second open lower end being distal to the second base member, the second retaining slot configured to receive the goggle strap through the second open lower end such that either the second front retaining arm or the second rear retaining arm is positioned between the goggle strap and the helmet and goggle strap is positioned between the other of the second front retaining arm or the second rear retaining arm and the helmet; and a stopping member affixed to the crown of the helmet at approximately an equal distance between the first and second retaining component and proximate to the front of the helmet, the stopping member having an elongated body extending away from the helmet such that the pair of goggles is engaged against the elongated body when the pair of goggles is moved upward from the eyes of the wearer.

6. The goggle retention apparatus of claim 5, wherein the elongated body of the stopping member is further defined as having a front facing side oriented toward the front of the helmet and a rear facing side oriented toward the rear of the helmet, the front facing side having a curvature configured to receive the pair of goggles when the pair of goggles are placed on the crown of the helmet.

7. The goggle retention apparatus of claim 5, wherein each of the first and second base members comprising:

a pivot channel configured to receive the associated first or second retaining member; and a pivot pin configured to pivotally secure the associated first or second retaining member within the pivot channel, such that the associated first or second retaining member can pivot around the pivot pin between a substantially vertical orientation and a non-vertical orientation.

* * * * *